US006883203B2

(12) United States Patent
Libes

(10) Patent No.: US 6,883,203 B2
(45) Date of Patent: Apr. 26, 2005

(54) UNIVERSAL JAMB BRACKET FOR A DOOR CLOSING SYSTEM

(76) Inventor: Barry Libes, 60 Moss La., Jericho, NY (US) 11753

( * ) Notice: Subject to any disclaimer, the term of this patent is extended or adjusted under 35 U.S.C. 154(b) by 192 days.

(21) Appl. No.: 10/059,034

(22) Filed: Jan. 29, 2002

(65) Prior Publication Data

US 2003/0140452 A1 Jul. 31, 2003

(51) Int. Cl.[7] ..... E05F 1/00
(52) U.S. Cl. ..... 16/71; 16/DIG. 43; 16/404
(58) Field of Search ..... 16/71, DIG. 43, 16/404, DIG. 21; D8/330, 380

(56) References Cited

U.S. PATENT DOCUMENTS 4,382,311 A 5/1983 Watts
4,648,151 A 3/1987 Whaley
4,825,509 A * 5/1989 Mitchell et al. ..... 16/382
5,829,098 A * 11/1998 Alonso ..... 16/71

* cited by examiner

*Primary Examiner*—Suzanne Dino Barrett
*Assistant Examiner*—Mark Williams
(74) *Attorney, Agent, or Firm*—Collard & Rue, P.C.

(57) ABSTRACT

A jamb bracket for a door closing system having an arm structure ending out from a basal element with two securing segments hugging an edge or corner of a doorjamb. The basal element has snap-off grooves with a decreased thickness allowing the portion of the basal element beyond the snap-off groove to be broken off if not needed. Two additional snap-off grooves separate the basal element from the securing segments so that the securing segments may be removed if necessary. The arm structure has two receiving areas for the pin of the door closing system. The jamb bracket is adaptable to become either a corner bracket for a corner/ceiling door closing system or an in-swinging bracket for an in-swinging door closing system.

12 Claims, 2 Drawing Sheets

UNIVERSAL JAMB BRACKET FOR A DOOR CLOSING SYSTEM

BACKGROUND OF THE INVENTION

1. Field of the Invention

The invention relates to door closing systems and more particularly to the jamb bracket of the system. The jamb bracket is mounted on a doorjamb and attaches the door closing system to the doorjamb. Door closing systems are conventionally mounted between a storm door and a wooden doorjamb to control the opening and closing of the door.

2. Prior Art

A door closing system normally comprises a piston assembly that includes a jamb bracket or stability control bracket. The jamb bracket is usually manufactured from a single piece of steel, which is stamped into a distinct and functional configuration. The jamb bracket distances the pivot connection for the door closing system from the doorjamb structure. It also provides a remote hinging area for securing the piston rod of the door closing system.

There are two main structures that normally comprise the jamb bracket; an arm structure and a basal structure. The arm structure is several inches long and resembles a flattened right triangle. Two vertically aligned holes support the remote hinging area. The door closing piston rod is fixated onto the remote hinging area with a pivot fastener pin. Whenever an attached door is opened or closed, the piston rod pivots at the remote hinging area.

The basal structure of the jamb bracket provides both stabilization and a fastening means. It normally provides four fastener screw holes for fixing the jamb bracket onto a doorjamb surface.

Forces and pressure are generated by the functioning door closing system onto the jamb bracket. Conventional door closing jamb brackets are problematic when a strong door opening force jerks and loosens the fasteners connecting the jamb bracket to the doorjamb. In order to remedy the loosened jamb bracket, the conventional approach is to relocate the jamb bracket or use longer screws. Both remedies frequently further tear out the doorjamb, damaging its appearance and reducing the effectiveness of the door closer.

Relocation of the jamb bracket can be done without moving the entire door closing system itself. However, if the jamb bracket is relocated inward toward the center of the doorjamb, maximum door swing is compromised. If the jamb bracket is relocated either above or below the worn holes, the result is a horizontal tilting of the door closing system.

Another more complicated yet permanent solution involves the complete relocation of the entire door closing system. However, because the placement of the door closing system is limited upon the doorjamb structure and the installation procedure is somewhat difficult, this solution is not entirely preferred. Therefore a loosened or detached jamb bracket often results in the removal of the deemed annoying door closing system.

Furthermore, when replacing a broken jamb bracket for a door closing system it is sometimes difficult to find a jamb bracket that fits the same dimensional requirements as the old jamb bracket and the requirements of the door closing system.

Other door closing systems exist that require differently shaped jamb brackets. One such system is a corner bracket systems. In this system a bracket is attached at the upper corner of the doorjamb where it attaches to the remainder of the door closing system. However, the bracket used in conventional systems is not ordinarily used in corner systems.

A second system that requires a differently shaped jamb bracket is that consisting of in-swinging brackets. The brackets of these systems are connected to the top portion of the in-swinging side of the door. They include a hole and post that attach the door and bracket to the remainder of the door closing system. The in-swinging brackets have a different shape than both the ordinary jamb bracket and the corner bracket.

SUMMARY OF THE INVENTION

The objects and advantages of this invention incorporate a larger basal element utilizing a larger area than the confined basal structure of an ordinary jamb bracket. Another object of this invention is to accommodate for a greater fastener area unto the doorjamb structure, consisting of more fastener screw holes. A further object of the invention is to provide a jamb bracket that is adaptable to fit corner-bracket and in-swinging bracket systems.

The basal element provides two securing segments. These segments extend perpendicularly from the basal element in order to hug the edge or corner of the doorjamb. This provides for greater stability and greater strength for the entire door closing system. The securing segments are attached through screw holes. These screw holes are countersunk so that the screw heads do not interfere with the action of the door.

The basal element also provides snap-off grooves. The snap-off grooves extend across the width of the basal element. The thickness of the metal at the barriers is significantly decreased from that of the remainder of the basal element. When the basal element is bent to a specific angle at the snap-off groove, an end of the basal element may be broken off. This gives the jamb bracket a "universal" quality, in that the basal element may be fitted to meet the requirements of the existing doorjamb. While it is important to have a large basal structure for greater stability, when installing a door closing system or replacing a jamb bracket in an existing door closing system, it is important for the jamb bracket to meet the dimensions of the existing doorjamb or system.

Additional snap-off grooves exist where the basal element and the securing segments meet. This allows the user to remove the securing segments if they are not needed for additional segment or if they do not meet the required dimensions of the doorjamb. The decreased thickness of the snap-off grooves allows the securing segment to detach when bent at the break-off barrier to a specific angle.

The identical top and bottom portions of the arm structure are joined by a connecting segment. This segment permits the jamb bracket to be fabricated from a single metal sheet.

Two screw holes, separated diagonally from each other, exist on each portion of the basal element that may be broken-off.

Two pivot holes exist at the free end of each arm structure for insertion of a pivot fastener pin in order to connect to a piston rod of a door closing system. Both pairs of holes are vertically aligned so that a single pin fits in two holes. There are two options in pin placement so that the jamb bracket may be universal in fitting many existing door closing systems, and so that it matches existing jamb brackets that have a hole for summer and winter use (changing the speed of the closing door).

The jamb bracket is adaptable as a corner bracket and an in-swinging bracket. For use as a corner bracket the top half of the basal element is bent at the first snap-off groove at a 90° angle so that it may fit the corner of the doorjamb. The basal element of the bracket may then be secured to both the upper and side portion of the doorjamb corner as its arm structure projects out horizontally from the doorjamb. The bracket may then be connected to a door closing system acting as a corner bracket.

Finally, the jamb bracket is adaptable as an in-swinging bracket. The securing segments are snapped off at the basal element and the bracket is secured to the top portion of the door with the basal element extending horizontally and the connecting segment facing the ground. A hole exists on the connecting segment and a post may be inserted into this hole for connection to an in-swinging door closing system.

BRIEF DESCRIPTION OF THE DRAWINGS

Other objects and features of the present invention will become apparent from the following detailed description considered in connection with the following drawings. It is to be understood, however, that the drawings are designed for the purpose of illustration only and not as a definition of the limits of the invention.

In the drawings, wherein similar reference characters denote similar elements throughout the several views.

DETAILED DESCRIPTION

Figure 1:
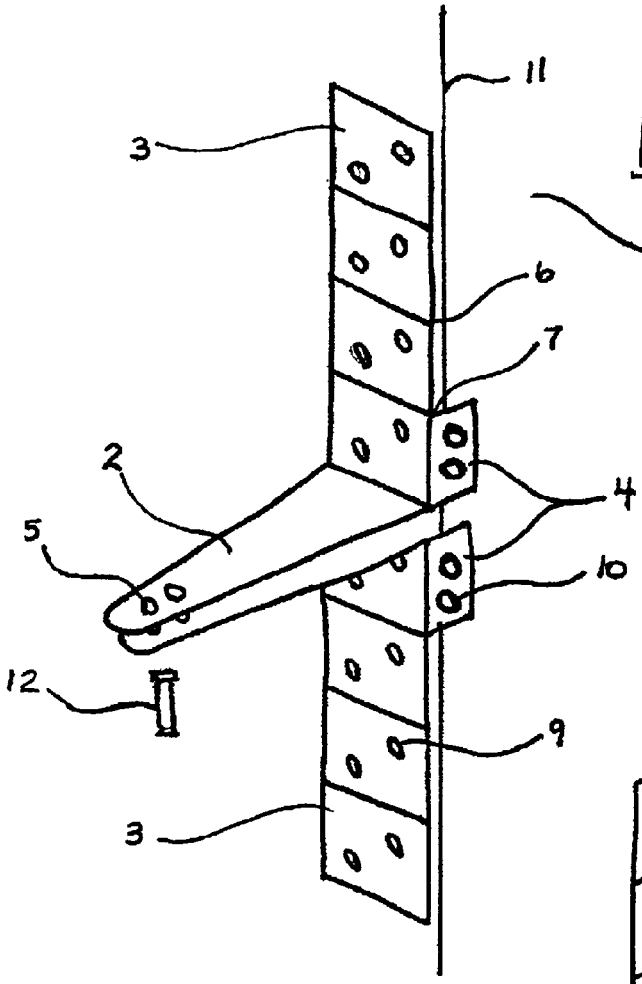
FIG. 1 is a front perspective view of the jamb bracket and doorjamb as defined by the invention.

FIG. 1 is a perspective view of the jamb bracket 1 used as part of a door closing system. Specifically, jamb bracket 1 secures the door closing system to doorjamb 11. Arm structure 2 extends outward from the center of the jamb bracket to meet the other elements of the door closing system. Arm structure 2 is 1–1 ¼" wide and has a top and bottom portion. The width of arm structure 2 is decreased from that of the normal jamb bracket to allow for weather-stripping of varying thickness. Four pivot holes 5 are disposed at the end of the arm structure 2, two in each portion. The respective holes are aligned vertically and those on the same portion of arm structure 2 are separated from each other by ⅜". Pivot fastener pin 12 of the door closing system is used to attach a piston rod to jamb bracket 1.

Basal element 3 extends perpendicularly above and below arm structure 2. Basal element 3 has a top and bottom portion. Basal element 3 lies flush against doorjamb 11 and is secured to it with screws. The outward facing side of basal element 3 is referred to as the front while the side flush against doorjamb 11 is referred to as the back.

Two securing segments 4 extend perpendicularly from the top and bottom portions of basal element 3 in the opposite direction of arm structure 2. Securing segments 4 fit around doorjamb 11 and extend ½" beyond basal structure 2. Securing segments 4 lie flush against the corner of doorjamb 11 and are attached to doorjamb 11 with screws.

Basal element 3 has snap-off grooves 6 on its front that extend across the width of basal element 3. At snap-off grooves 6, the thickness of the metal is significantly smaller than the rest of jamb bracket 1. This allows the metal to break easier when bent at snap-off grooves 6. In breaking off a section of basal element 3, the size of jamb bracket 1 may be adjusted to fit existing doorjamb dimensions. It also allows sections of basal element 3 to be removed when they are not necessary for the support means of jamb bracket 1. The decreased thickness of snap-off grooves 6 and the type of metal used in fabrication allow for a complete detachment when basal element 3 is bent at break off barrier 6 to a specific angle.

Two additional snap-off grooves 7 exist at the corner where basal element 3 meets securing segments 4. These allow securing segments 4 to be removed if they do not fit the dimensions of the existing doorjamb or if they are not necessary for securing jamb bracket 1 to doorjamb 11. The decreased thickness and the type of metal used in fabrication allow securing segments 4 to detach when bent at additional snap-off grooves 7 to a certain angle.

Figure 2:
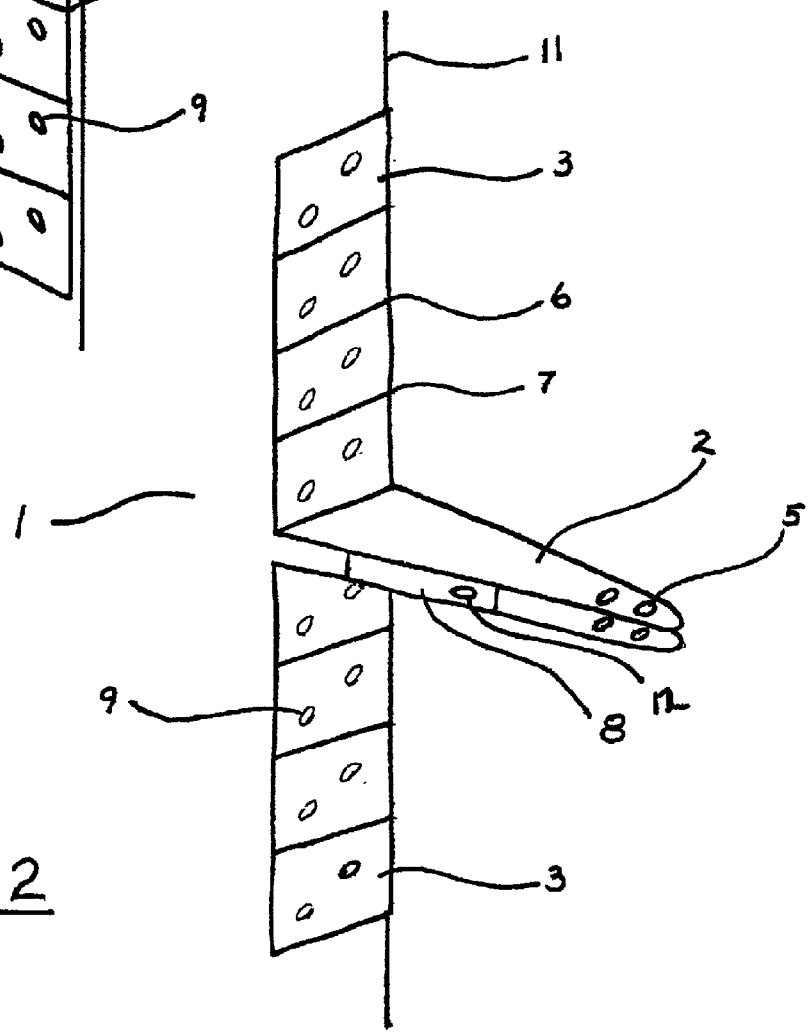
FIG. 2 is a back perspective view of the jamb bracket as defined by the invention.
Figure 3:
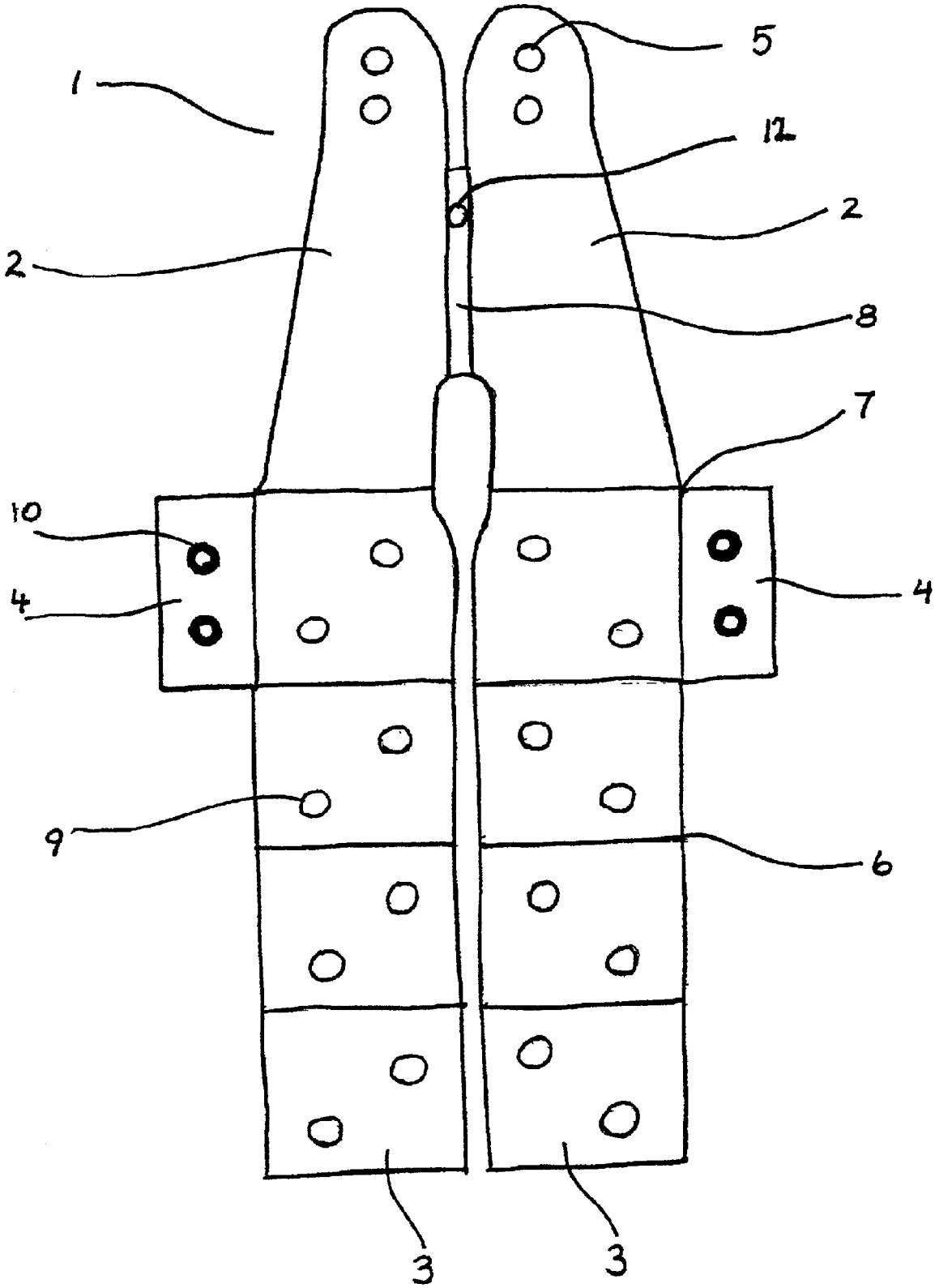
FIG. 3 is a top view of the jamb bracket after being cut from a metal sheet but before folded into shape.

In FIG. 2 and FIG. 3 connecting segment 8 is shown. Connecting segment 8 runs along a portion of the length of arm structure 2 and joins the two identical portions of arm structure 2. Connecting segment 8 makes it possible to fabricate jamb bracket 1 as a single element.

Two screw holes 9 exist on each segment of basal element 3 separated by snap-off grooves 6. Screw holes 9 are disposed in diagonally opposite corners of the segments of basal element 3.

Two countersunk screw holes 10 exist in each securing segment 4. Countersunk screw holes 10 are countersunk so that when jamb bracket 1 is attached to doorjamb 11 the screw heads are not interfering with the action of the door and the door closing system.

Jamb bracket 1 shown in FIG. 1 may be adapted as a corner bracket. Basal element 3 above arm structure 2 is bent at a snap-off groove 6 located closest to arm structure 2. Jamb bracket 1 may then fit into the upper corner of a doorjamb, secured to the top and side of the doorjamb corner as arm structure 2 projects out horizontally from the doorjamb. The bracket may then be connected to a door closing system.

In another embodiment jamb bracket 1 shown in FIG. 1 may be adapted as an in-swinging bracket. Securing segments 4 are snapped off at additional snap-off groves 7. Jamb bracket 1 is oriented so that basal element 3 extends horizontally and connecting segment 8 faces the ground. Jamb bracket 1 is attached to the top of a door. The in-swinging bracket is connected to the in-swinging door system by a post that may be double threaded or take the form most common in the art. The post is inserted into central hole 12 located in connecting segment 8 and joining the bracket and door to the system.

Accordingly, while at least one embodiment of the present invention has been shown and described, it is to be understood that many changes and modifications may be made thereunto without departing from the spirit and scope of the invention as defined in the appended claims.

What is claimed is:

1. A jamb bracket for a door closing system comprising:

at least one arm structure extending out from the middle of the jamb bracket, wherein said at least one arm structure comprises a top and a bottom portion and has an attached and an unattached end;

a connecting segment uniting said top and said bottom portions of said at least one arm structure;

a basal element extending perpendicularly outward above and below said attached end of said at least one arm structure, wherein said basal element comprises a top and a bottom portion, and a front and a back; and at least one snap-off groove extending across the width of said basal element, wherein the thickness of said basal element is decreased at said at least one snap-off groove allowing the portion of said basal element beyond said snap-off groove to be broken off;

wherein at least one securing segment extends perpendicularly from said basal element in the opposite direction of said at least one arm structure, wherein said at least one securing segment fits around an edge or corner of a doorjamb;

wherein at least one additional snap-off groove is located at an edge where said basal element meets said at least one securing segment, wherein the thickness of said basal element is decreased at said at least one additional snap-off groove allowing said at Least one securing segment to be broken off; and wherein said at least one securing segment is snapped off at said at least one additional snap-off groove and the jamb bracket is oriented horizontally at the top of a door with said connecting segment facing the ground so that it may act as an in-swinging bracket for an in-swinging door closing system.

2. The jamb bracket of claim 1, wherein at least one pivot hole is disposed at said unattached end of said at least one arm structure for receiving a pivot fastener pin used to fix a piston rod thereto.

3. The jamb bracket of claim 1, wherein at least one securing segment extends perpendicularly from said basal element in the opposite direction of said at least one arm structure, wherein said at least one securing segment fits around an edge or corner of a doorjamb.

4. The jamb bracket of claim 3, wherein at least one additional snap-off groove is located at an edge where said basal element meets said at least one securing segment, wherein the thickness of said basal element is decreased at said at least one additional snap-off groove allowing said at least one securing segment to be broken off.

5. The jamb bracket of claim 3, wherein at least one countersunk screw hole is disposed in said at least one securing segment.

6. The jamb bracket of claim 3, wherein said at least one securing element extends ½" beyond said basal element.

7. The jamb bracket of claim 3, wherein said basal element is bent at a 90° angle along said at least one snap-off groove and above said attached end of said at least one arm structure so that the jamb bracket may act as a corner bracket in a corner of a door jamb.

8. The jamb bracket of claim 1, wherein at least one screw hole is disposed in both of said top and bottom portions of said basal element.

9. The jamb bracket of claim 1, wherein said connecting segment has a central hole.

10. The jamb bracket of claim 1, wherein said at least one arm structure is 1 ¼" wide.

11. The jamb bracket of claim 1, wherein said at least one snap-off groove is on said front of said basal element.

12. The jamb bracket of claim 1, wherein there are three snap-off grooves disposed on each of said top and bottom portions of said basal element.

* * * * *

UNITED STATES PATENT AND TRADEMARK OFFICE

CERTIFICATE OF CORRECTION

PATENT NO. : 6,883,203 B2
DATED : April 26, 2005
INVENTOR(S) : Libes

It is certified that error appears in the above-identified patent and that said Letters Patent is hereby corrected as shown below:

Column 5,
Line 15, after the word "at" please change "Least" to correctly read -- least --.

Signed and Sealed this

Twelfth Day of July, 2005

JON W. DUDAS
*Director of the United States Patent and Trademark Office*